US006305360B1

(12) United States Patent
Hurley

(10) Patent No.: US 6,305,360 B1
(45) Date of Patent: Oct. 23, 2001

(54) FUEL PURGE CONTROL

(75) Inventor: Richard William Hurley, Glen Waverly (AU)

(73) Assignee: Oribital Engine Company (Australia) PTY Limited, Western Australia (AU)

( * ) Notice: Subject to any disclaimer, the term of this patent is extended or adjusted under 35 U.S.C. 154(b) by 0 days.

(21) Appl. No.: 09/147,478

(22) PCT Filed: Jul. 10, 1997

(86) PCT No.: PCT/AU97/00439

§ 371 Date: Jan. 7, 1999

§ 102(e) Date: Jan. 7, 1999

(87) PCT Pub. No.: WO98/01663

PCT Pub. Date: Jan. 15, 1998

(30) Foreign Application Priority Data

Jul. 10, 1996 (AU) ..... PO 0951

(51) Int. Cl.[7] ..... F02M 37/04
(52) U.S. Cl. ..... 123/520; 123/516
(58) Field of Search ..... 123/520, 521, 123/519, 518, 516, 198 DB, 357

(56) References Cited

U.S. PATENT DOCUMENTS

| | | | | |
|---|---|---|---|---|
| 5,050,568 | | 9/1991 | Cook | 123/521 |
| 5,115,785 | | 5/1992 | Cook | 123/520 |
| 5,117,797 | | 6/1992 | Telep et al. | 123/520 |
| 5,143,040 | | 9/1992 | Okawa et al. | 123/684 |
| 5,277,167 | | 1/1994 | DeLand et al. | 123/518 |
| 5,445,132 | | 8/1995 | Isobe et al. | 123/520 |
| 5,448,981 | | 9/1995 | Cook et al. | 123/520 |
| 5,474,049 | | 12/1995 | Nagaishi et al. | 123/520 |
| 5,535,719 | * | 7/1996 | Morikawa | 123/520 |
| 5,558,072 | | 9/1996 | Harima et al. | 123/677 |
| 5,606,955 | * | 3/1997 | Yuda | 123/520 |
| 5,609,142 | * | 3/1997 | Osanai | 123/520 |
| 5,611,320 | * | 3/1997 | Hara | 123/520 |

FOREIGN PATENT DOCUMENTS 0 591 744 B1 12/1995 (EP) .

* cited by examiner

*Primary Examiner*—Carl S. Miller
(74) *Attorney, Agent, or Firm*—Arent Fox Kintner Plotkin & Kahn, PLLC

(57) ABSTRACT

A method for controlling delivery of fuel from a vapor collection device to the combustion chamber of an internal combustion engine to thereby purge fuel that has accumulated in the vapor collection device by means of a purge flow passing from the vapor collection device to the engine, the purge flow rate being varied by means of a flow control valve located between the vapor collection device and the engine, the method including determining a minimum valve signal value and a maximum valve signal value as a function of the engine load end engine, the method including determining a minimum and maximum extent of valve signal values for controlling the opening of the valve, selecting either the minimum or maximum valve signal value or an interpolation between the maximum and minimum values in dependence on the engine operating conditions to optimize the amount of fuel purged from the vapor collection device to the engine under varying engine operating conditions. In an internal combustion engine having a primary fuel source, and a system for delivering fuel vapor produced in the fuel system of the internal combustion engine to at least one combustion chamber thereof, a method of determining the amount of fuel vapor being purged during closed loop operation of the engine, including: determining the amount of fuel being provided to the engine by the primary fuel source; and comparing this value to a predetermined estimate of required total fuelling level.

30 Claims, 3 Drawing Sheets

FUEL PURGE CONTROL

This invention relates to the control of the purging of fuel from the fuel vapour collection device for an internal combustion engine.

The current emission regulations in many countries require the evaporative emissions from the fuel supply system of the internal combustion engines of motor vehicles to be controlled to thereby eliminate or substantially reduce the amount of fuel released into the atmosphere by such vapours. Accordingly, it is normal practice to fit a fuel vapour collection device to the vehicle to adsorb evaporative emissions from the fuel supply system under all conditions that the vehicle experiences. This fuel vapour collection device is usually of the activated carbon type and is commonly referred to as the "carbon canister". Such a fuel vapour collection device operates on the principle of physical adsorption of fuel vapour into the activated carbon.

The fuel vapour collection device has a limited capacity for storing fuel and must therefore be purged to some extent of its contents in the course of vehicle operation. The accumulated fuel is normally purged into the intake manifold of the engine by air drawn through the fuel vapour collection device, the purged fuel being subsequently combusted by the engine. The amount of fuel vapour being purged from the fuel vapour collection device can however vary significantly for any given purge air flow rate generally depending on saturation level in the fuel vapour collection device. As the amount of purged fuel is not normally measured in systems not having an air/fuel ratio feedback mechanism (commonly known as open loop systems), the engine control system cannot compensate for the increased fuelling rate to the engine. This can cause an increase in the engine torque which results in a higher engine speed at idle or an increase in the vehicle speed off idle. Under severe conditions, the engine operation can become unstable because the actual air fuel ratio within the engine cylinders is markedly different from the air fuel ratio mapped by the engine control system.

One proposal to deal with this problem is described in the applicant's U.S. Pat. No. 5,245,974. This document shows an internal combustion engine installation having a fuel vapour collection device for removing the fuel vapour from the evaporative emissions generated within the fuel supply system. The engine includes a fuel injection system with an air compressor supplying compressed air to the fuel injection system. The fuel vapour collection device is periodically purged of accumulated fuel by drawing air through the fuel vapour collection device using the air compressor. The air compressor then supplies the air which now carries the fuel to the fuel injection system where the air is subsequently injected into the combustion chambers of the engine resulting in combustion of the purged fuel. Although the stratification within the cylinder will remain largely unaltered by the addition of the purged fuel through the injector, this patent does not particularly address the problem of lack of knowledge of the amount of fuel being supplied from the fuel vapour collection device.

It would be advantageous to provide a system which can control the air flow rate through the fuel vapour collection device to optimise the amount of fuel that is purged from the fuel vapour collection device without jeopardising engine operation.

With this in mind, it is an object of the present invention to provide an improved method and control system for controlling the air flow rate through an fuel vapour collection device for an internal combustion engine.

According to one aspect of the present invention, there is provided a method for controlling delivery of fuel from a vapour collection device to the combustion chamber of an internal combustion engine to thereby purge fuel that has accumulated in the vapour collection device by means of a purge flow passing from the vapour collection device to the engine, the purge flow rate being varied by means of a flow control valve located between the vapour collection device and the engine, the method including determining a minimum valve signal value and a maximum valve signal value as a function of the engine load and engine speed to thereby respectively define the minimum and maximum extent of valve signal values for controlling the opening of the valve, selecting either the minimum or maximum valve signal value or an interpolation between the maximum and minimum values in dependence on the engine operating conditions to optimise the amount of fuel purged from the vapour collection device to the engine under varying engine operating conditions.

This method enables at least substantially continuous purging of the fuel vapour collection device and enables the amount of fuel purged from the fuel vapour collection device to the engine to be optimised for varying operating conditions of the engine.

The fuel vapour collection device may be in communication with an intake manifold of the engine and the method can therefore control the amount of fuel purged into the intake manifold. The pressure difference between the fuel vapour collection device and the intake manifold may be sufficient to enable air to be drawn through the fuel vapour collection device to the intake manifold. The present method may however also be used in other arrangements, for example when there is purging through an air compressor as described in U.S. Pat. No. 5,245,974 referred to above.

The method may be implemented by a variable valve for controlling the air flow rate from the fuel vapour collection device and a control means for controlling the valve as a function of the engine operating conditions. The control means may be in the form of an electronic control unit (ECU) for providing the valve with the required valve signal values for controlling the progressive opening anrd closing of the valve. A given valve signal may correspond to a given valve position.

The ECU may include at least two "look-up" maps for mapping the valve signal values for controlling the valve as a function of engine operating conditions. Each look-up map may provide valve signal values against the coordinates of fuel per cycle (FPC) and engine speed (RPM). One of the maps may be a "minimum" map which maps the valve signal values when the amount of purge air flow to the engine is required to be at a minimum level. This situation can for example arise when air purged from the vapour collection device is very rich in fuel vapour. Another map may be a "maximum" map mapping the valve signal values when the purge air flow to the engine can be maximised. This takes into account situations where the air fuel ratio of the purge air is relatively low and the engine is operating at medium to high loads.

The minimum and maximum maps may therefore respectively define the minimum and maximum range of valve signal values for controlling the opening of the valve and therefore the purge air flow rate, the opening of the valve progressively increasing with increasing valve position values. The valve signal value may be obtained from either of these maps or from an interpolation between these maps in dependence on the engine operating conditions. The interpolation amount may be provided by an adaption value. The adaption value may be provided by an arbitrary value system which assigns a proportion of each of the minimum and maximum values to create a total value for valve position determination according to given condition. This adaption value may lie within the range of 0.0 to 1.0, with the 0.0 value corresponding to the minimum map and the 1.0 value corresponding to the maximum map.

An adaption value look-up map may map the adaption values as a function of the engine coolant temperature. Upon first starting up the engine, the water temperature may be measured and an initial adaption value obtained from the adaption value map. This ensures that if the engine is starting hot, the adaption value may be relatively low to restrict the flow of purged air. Under hot starting conditions, relatively large amounts of fuel vapour may have been generated within the fuel tank which is then adsorbed within the fuel vapour collection device. The valve position following a hot start can therefore prevent excessive fuel being purged at that time.

Advantageously, the present method may be applied to engine control systems which generally operate under open loop control (that is, without exhaust air/fuel ratio feedback), and which are provided with engine speed feedback at idle to control idle operation (known as closed loop speed control). In such systems, the ECU monitors engine speed at idle and alters fuelling (whether by direct control of the fuelling rate or by air flow rate control) to maintain engine speed at the desired idling speed.

In a preferred embodiment, the primary fuel supply to the engine is provided by one or more fuel injectors so that supply of fuel other than from the fuel vapour collection device can be accurately controlled. This can be done via manifold or direction injection.

According to the present method, the adaption value may be periodically varied with changing operating conditions of the engine. When the engine is at idle, the adaption value may be varied by comparing the actual idle fuelling level to a preset target fuelling level. This target fuelling level may be a mapped value provided by the ECU. The engine typically operates under closed loop engine speed control at idle. Under closed loop operation, feedback on the engine speed is supplied to the ECU which then seeks to maintain a constant engine speed by altering the fuelling level. This idle fuelling level is compared against the preset target fuelling level. The target fuelling level would typically be below the normal fuelling level of the engine at idle where no fuel is provided through the fuel vapour collection device but above a fuelling level that would cause combustion instability or loss of engine control by the ECU.

If the idle fuelling level is above the target fuelling level, then the adaption value may be incremented by a specified amount. This would for example take into account the situation where there was little fuel coming from the fuel vapour collection device so that the idle fuelling level would be high because it was not being supplemented by fuel from the fuel vapour collection device. As such, where the actual idle fuelling level is above the target value, the valve controlling the purge air flow rate could be opened further by a small amount. This is effected by incrementing the adaption value.

On the other hand, if the idle fuelling level is below the target fuelling level, then the adaption value may be decremented by a preset amount. This for example takes into account the situation where a lot of fuel was being purged from the fuel vapour collection device to the engine. This would result in the actual idle fuelling level being low as a result of the reduction in the fuelling level being initiated by the ECU under closed loop speed control to keep the engine idle speed at a predetermined level. If the fuelling level through the primary fuel supply was low with a significant amount of fuel being purged from the fuel vapour collection device, then the combustion within the combustion chambers may become unstable. In this case, the adaption valve may be decremented to reduce the flow through the fuel vapour collection device and thus the amount of fuel being purged from the fuel vapour collection device into the combustion chamber. To help improve combustion stability, an air flow offset may be added when the adaption value is decremented to increase the bulk air flow to the engine. Furthermore, an air flow offset may be removed if the adaption value is incremented. The airflow offset may simply be the addition of a specified airflow to the bulk manifold airflow by adjustment of an electronically controllable airflow device such as a DAR-valve device as described in the Applicant's U.S. Pat. No. 5,251,597.

Idle fuelling level may be compared to a limit value to check whether it is too low (ie in the case where too small a proportion of total fuel supplied is being delivered through the injector). If this condition is extreme, such that engine instability is likely due to a high proportion of the fuel being supplied from the vapour collection device, then the adaption value may be set (preferably immediately) to 0.0 to promptly reduce the possibility of combustion instability within the engine. It may also be preferable to add the above noted air flow offset when the adaption value is set to zero if so required.

In certain systems, the engine operates in open loop mode when off-idle, and there is no mechanism to enable measurement of fuel being delivered from the fuel vapour collection device. In this case, it would be possible to assume that conditions under which the engine is operating do not change, and simply operate the fuel vapour collection device at the adaption rate set by the previous idle adaption value setting. However, as operating conditions may change over time, there is an increasing uncertainty as to whether the previous setting of the adaption value at idle is appropriate for the present conditions.

The adaption value may therefore be progressively reduced when the engine is off idle and in a running mode to compensate for the increasing uncertainty of the fuel concentration in the purged air as the period since the last determination of the purge rate increases. To this end, the adaption rate may be periodically decremented by a specified amount during an off-idle period of engine operation. For example, if the engine was cold on start-up and the adaption value set at a relatively high value, and the vehicle driven by the engine operated for a period of time, then the temperature of the fuel within the fuel tank could increase substantially leading to increased evaporative emissions and an increase in the charge of the fuel vapour collection device. Therefore, if the purge rate was not reduced, then the purge rate may be inappropriate at light loads causing poor running of the engine.

The adaption value may therefore be determined and varied during the following operating stages of the engine:

a) at engine start-up,
b) in idle mode of the engine, and
c) in running mode at specified time intervals since the last adaption value check.

According to another aspect of the present invention, there is provided in an internal combustion engine having a primary fuel source, and a system for delivering fuel vapour produced in the fuel system of the internal combustion engine to at least one combustion chamber thereof, a method of determining the amount of fuel vapour being purged during closed loop operation of the engine, including:

determining the amount of fuel being provided to the engine by the primary fuel source; and comparing this value to a predetermined estimate of required total fuelling level.

A compensation factor may be applied to the predetermined estimate of required total fuelling level to compensate for additional loading of the engine. The additional loading may for example be applied by an air conditioning unit or other known specific energy drain on the engine, and a specific compensation factor is applied in relation to each known energy drain on determination that the particular energy drain has been applied.

Closed loop operation may occur whilst the engine is in idle mode. The predetermined estimate of required total fuelling level may be provided by a pre-calibrated look-up map in an electronic control unit of the engine. Alternatively, or in addition, the predetermined estimate of required total fuelling level for a given set of operating conditions may be provided by operating the engine at that given set of conditions with a zero level of purge.

To provide a better understanding of the present invention, an exemplary control strategy according to the present invention will be described with respect to the accompanying drawings. It is however to be appreciated that the present invention is not restricted to the particularities of the described control strategy and does not supersede the generality of the preceding description.

The control strategy according to an embodiment of the present invention requires a valve for controlling the air flow through the fuel vapour collection device and an electronic control unit (ECU) for providing control signals to the valve. The valve is typically in the form of an electromagnetically actuated valve and is referred to herein as the purge solenoid valve.

The ECU includes two look-up maps, each respectively plotting purge solenoid signal values against the co-ordinates of engine fuelling level and engine speeds. One of the look-up maps, is the "maximum" map which provides valve signal values corresponding to maximum purge air flow to the engine for the given operating conditions of the engine. The other map provides valve signal values for when the purge air flow rate through the fuel vapour collection device is required to be at a minimum. These look-up maps respectively define the minimum and maximum extent of the range of valve signal values for the purge solenoid valve for given engine load and speed values. Valve signal values between the two maps can be obtained by means of an adaption value, the determination of which will be subsequently described. This adaption value allows valve signal values to be interpolated between the two maps. The adaption value lies between the range of 0.0 to 1.0 with the 0.0 value corresponding to valve signal values from the minimum map and the 1.0 value corresponding to valve signal values from the maximum map.

It should be noted that at higher levels of engine fuelling and engine speed, the amount of purging through the fuel vapour collection device on the basis of the minimum map need not be significantly different from the maximum map. It is most important at low fuelling and engine speeds, where excess fuelling through the fuel vapour collection device is more likely to impact on engine operation, that a greater differential exists between maximum and minimum maps to enable the engine control system to decrease the amount of air flowing through the fuel vapour collection device by tending towards a lower adaption value corresponding to the minimum map.

Figure 1:
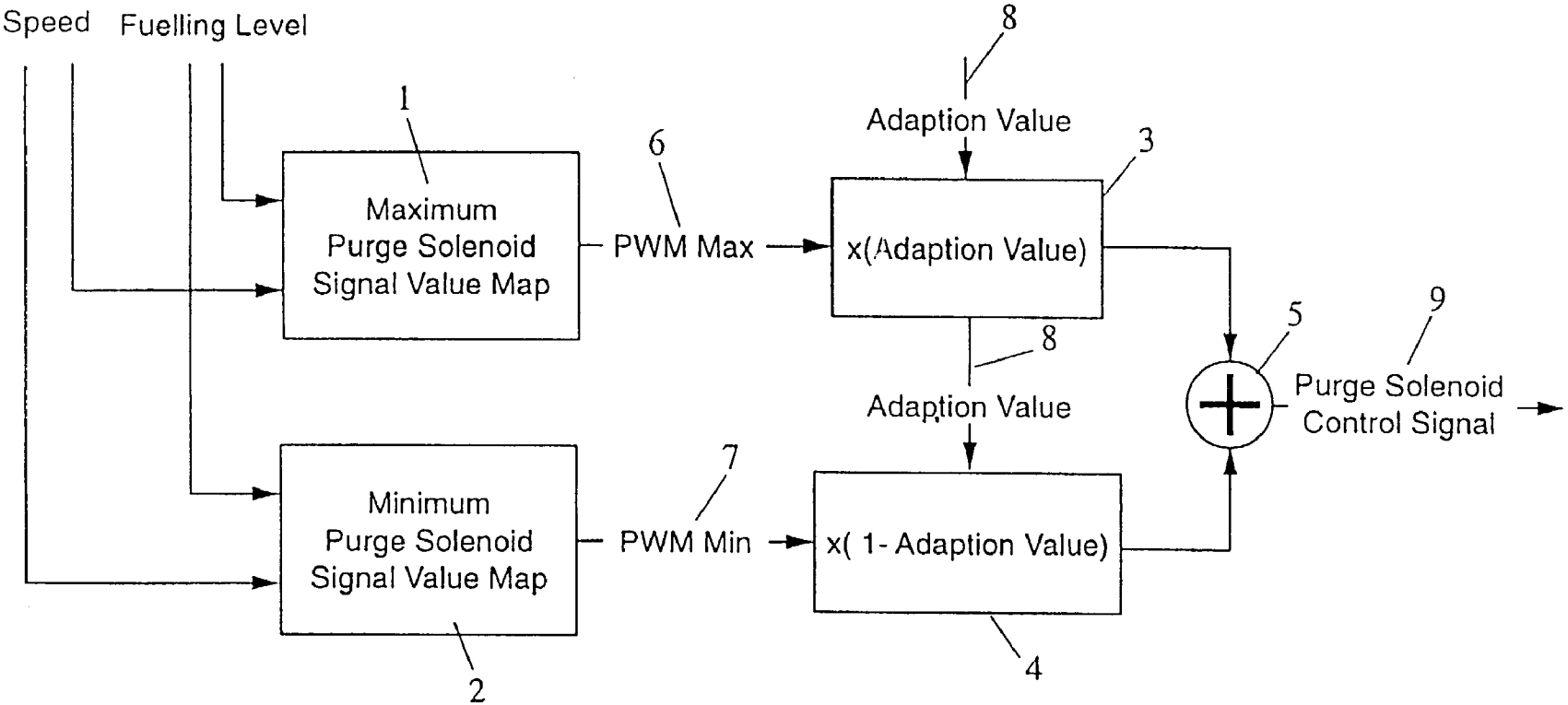
FIG. 1 is a flow chart showing the control strategy for determination of the valve control signal.

Referring to FIG. 1, the purge solenoid control signal is determined as follows. Firstly, a valve signal value 6 is respectively obtained from the maximum map at step 1 and a second valve signal value 7 obtained from the minimum map at step 2, each map using the actual fuel per cycle to the engine (FPC) and engine speed as co-ordinates when obtaining their respective valve signal values. At step 3 the valve signal value 6 from the maximum map is multiplied by an obtained adaption value 8. At step 4, the valve signal value 7 obtained from the minimum map is multiplied by 1 minus the same adaption value 8. The results from steps 3 and 4 are then added at step 5 provide the purge solenoid control signal 9.

Figure 2:
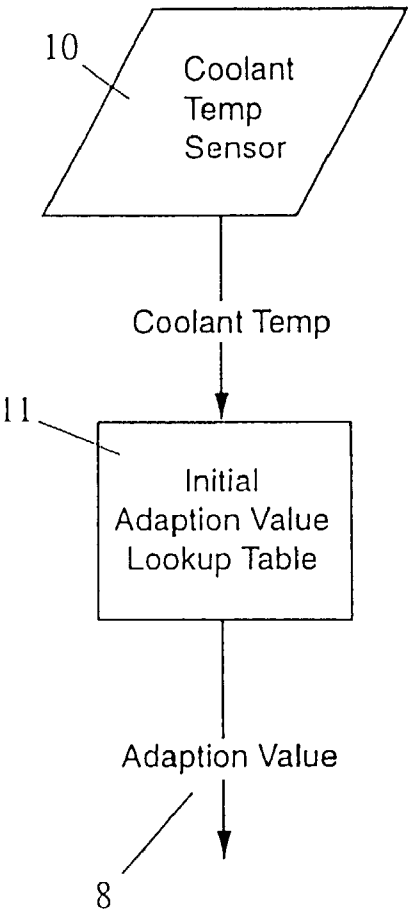
FIG. 2 is a flow chart showing the determination of the adaption value at cranking of the engine.

The adaption value is obtained and varied under different engine operating modes as follows. Referring initially to FIG. 2, the initial adaption value is obtained during cranking of the engine. The coolant temperature at cranking of the engine is obtained by means of a coolant temperature sensor at step 10. The ECU includes an adaption value look-up table which plots the adaption value against the coolant temperature. Therefore, at step 11, the initial adaption value is obtained as a function of the coolant temperature at cranking. The control strategy therefore commences using this initial adaption value.

Figure 3:
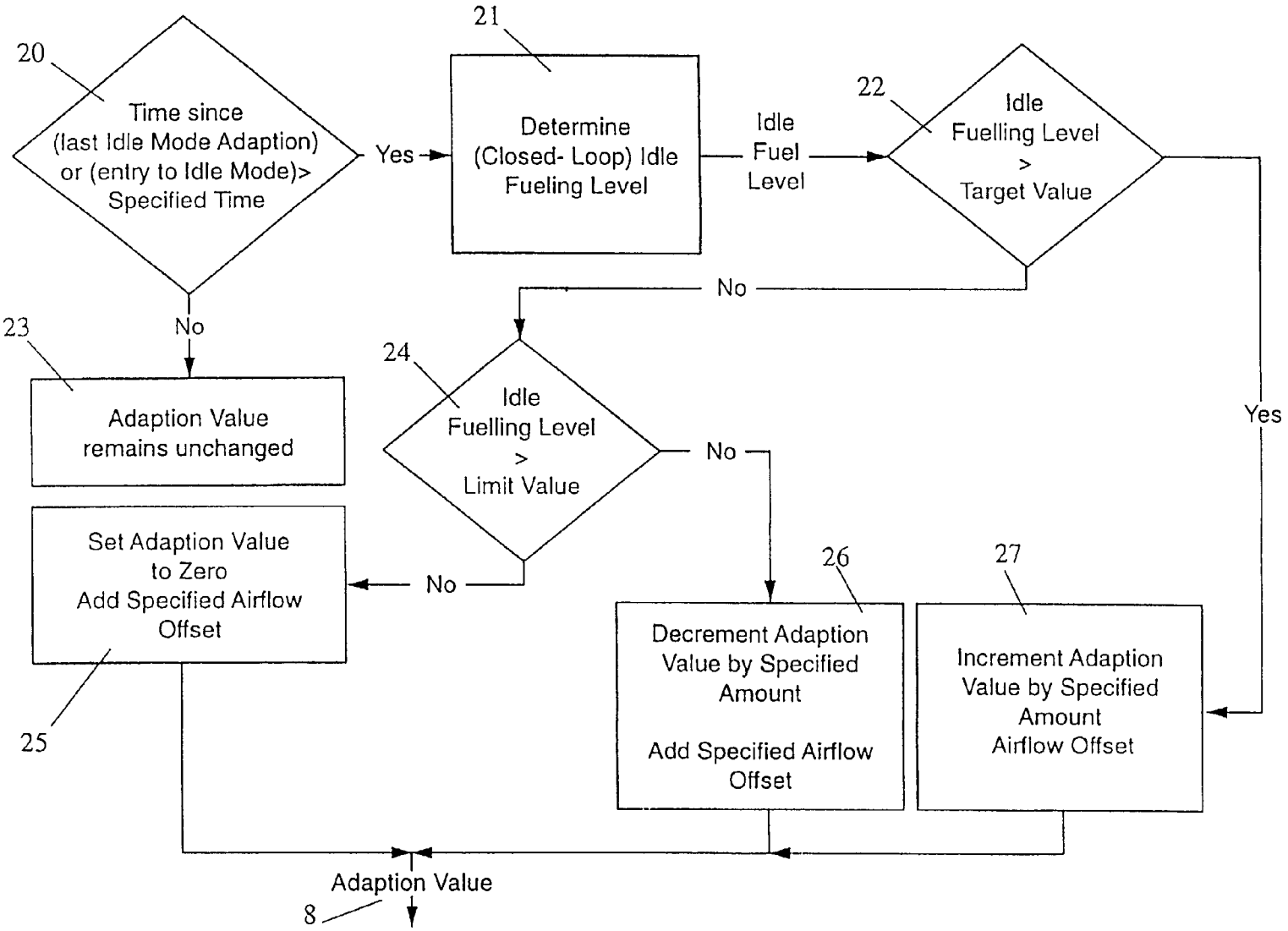
FIG. 3 is a flow chart showing the determination of the adaption value at the idle mode of the engine.

During engine idle, the adaption value can be varied according to the control strategy as shown in FIG. 3. At step 20, the time since the last variation of the adaption value within the idle mode or the time since the entry to the idle mode is compared against a specified time. If these noted times are less than the specified time, then the adaption value remains unchanged as shown in step 23. However, if the noted times are greater than the specified time, then the adaption value is varied as follows. At step 21, the closed loop idle fuelling level is determined. At step 22, this idle fuelling level is compared against a target value provided by the ECU. If the idle fuelling level is greater than the target value, then the adaption value is incremented by a specified amount at step 27. This incremented adaption value then forms the adaption value for the control strategy. However, if the idle fuelling level is less than the target value, then the idle fuelling level is compared against a limit value also provided by the ECU at step 24. If the idle fuelling level is greater than the limit value, then the adaption value is decremented by a specified amount at steps 26. Furthermore, a specified airflow offset is added. If the idle fuelling level is less than this limit value, then the adaption value is set to 0.0 and the specified airflow offset is added at step 25.

In one embodiment, the primary source of fuel to the combustion chamber of the engine is a metered fuel injection system. In this case the amount of fuel delivered by the primary source of fuel can be determined by monitoring the fuel metered by the injection system. As such, the amount of fuel delivered to the combustion chamber from the vapour collection device can be reasonably accurately determined.

Further arrangements may be provided to improve the combustion stability in the combustion chamber. One arrangement is the use of airflow offsets independent from the control of the air flow through the fuel vapour collection device. For example, in steps 25 and 26, specified airflow offsets may be added to increase the bulk air flow to the engine. The increase in the fresh airflow decreases the possibility of instability in the combustion chamber. It is also envisaged that a specified airflow offset be removed as for example in step 27. The above arrangement therefore provides a possible backup measure to the present invention. It should however be noted that the present control method can readily operate without such a back-up arrangement.

Figure 4:
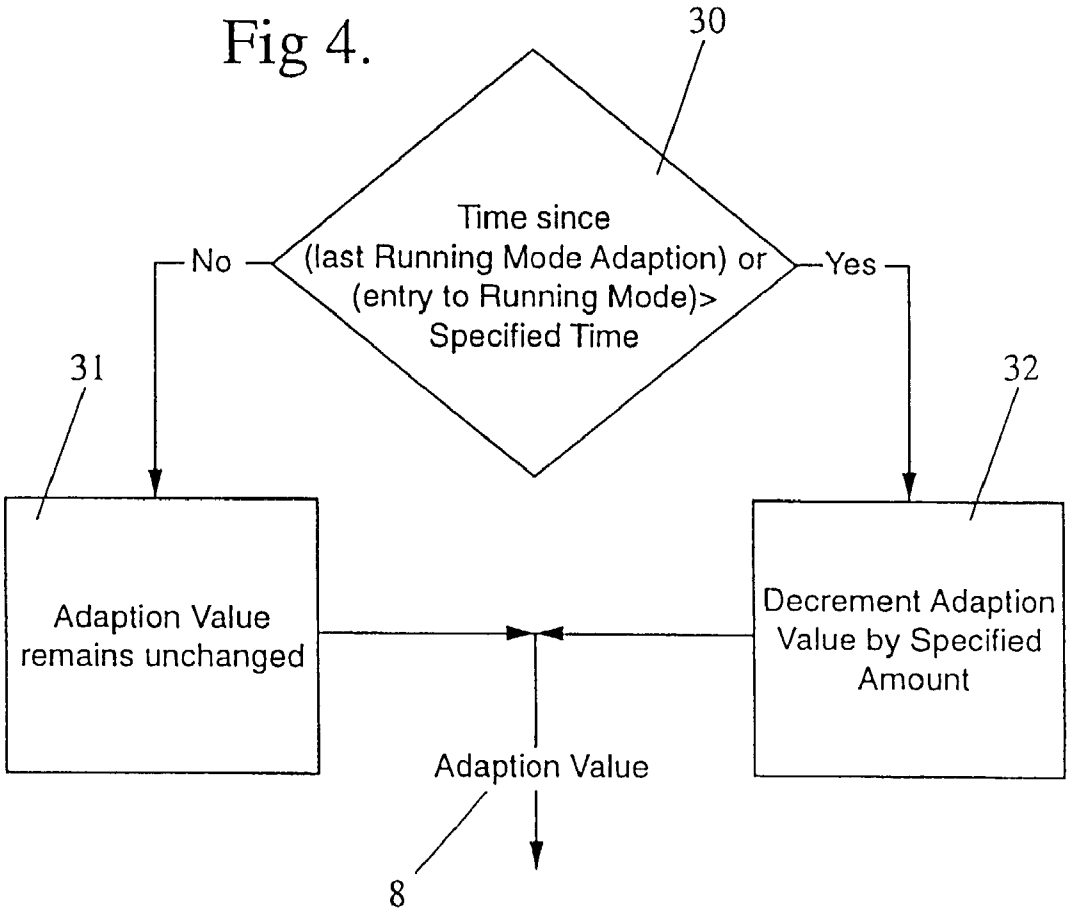
FIG. 4 is a flow chart showing the determination of the adaption value during the running mode of the engine.

When the engine is operating in running mode, a simpler control strategy is used as shown in FIG. 4. At step 30, the time since the last variation of the adaption value while in the running mode or the time since the entry to the running mode is compared against a specified time. If this time is greater than the specified time, then the adaption value is decremented by a specified amount in step 32. However, if the above time is less than the specified time, then the adaption value remains unchanged as shown at step 31.

The adaption value obtained at any of the above operating modes of the engine are used in determination of the purge solenoid control signal 9 as shown in steps 3 and 4 of FIG. 1.

When various incrementations and decrementations to the adaption value are made, a change in the adaption value of 0.1 is typical, but, of course, may be varied.

What is claimed is:

1. A method for controlling delivery of fuel from a vapour collection device to at least one combustion chamber of an internal combustion engine to thereby purge fuel that has accumulated in the vapour collection device by means of a purge flow passing from the vapour collection device to the engine, the purge flow rate being varied by means of a flow control valve located between the vapour collection device and the engine, the meth comprising the following steps, determining minimum valve signal value and a maximum valve signal value as a function engine load and engine speed to thereby respectively define a minimum and maximum extent of valve signal values for controlling opening of the valve, selecting either one of the minimum valve signal value, the maximum valve signal value and an interpolation value that is between the maximum and minimum value signal values in which such selecting is performed in dependence on the engine operating conditions to optimise an amount of fuel purged from the vapour collection device, wherein the amount of interpolation between the respective minimum and maximum valve signal values is provided an adaptation value for obtaining an intermediate valve signal value between said minimum and maximum signal values, the method further including determining an adaptation value as a function of the coolant temperature of the engine, wherein the engine is operated under closed loop speed control at idle operation of the engine and is operated under open loop control under other engine operating conditions.

2. A method according to claim 1 further including periodically varying the adaption value with changing operating conditions of the engine.

3. A method according to claim 1 including determining an initial adaption value upon first starting up the engine, such that the initial adaption value is relatively low if the engine coolant temperature is relatively high to thereby restrict a purge air flow to the engine and such that the initial adaption value is relatively high if the engine coolant temperature is relatively low to thereby provide for a greater purge air flow to the engine.

4. A method according to claim 1 when the engine is at idle, further including varying an adaption value by comparing the idle fueling level to the engine to a specified target fuelling level, incrementing the adaption value by a specified amount if the idle fuelling level is above the target fuelling level, and decrementing the adaption value by a specified amount if the idle fuelling level is below the target fuelling level.

5. A method according to claim 1 further including adding a specified air flow offset when the adaption value is decremented and removing a specified air flow offset when the adaption value is incremented.

6. A method according to claim 4 further including comparing the idle fuelling level to a specified limit value if the idle fuelling level is less than the specified target fuelling level, and setting the adaption value to zero if the idle fuelling level is less than the limit value.

7. A method according to claim 6 further including adding a specified air flow offset if said adaption value is set to zero.

8. A method according to claim 6 further including varying the adaption value following a specified period after a last variation of the adaption value or since the entry of the engine into idle operation.

9. A method according to claim 1 when the engine is operating under open loop control, further including periodically decrementing the adaption value by a preset amount.

10. A method according to claim 1 wherein the fuel is purged into an intake manifold of the engine.

11. An engine control unit for, in use, controlling delivery of fuel from a vapour collection device to at least one combustion chamber of an internal combustion engine to thereby purge fuel that has accumulated in the vapour collection device by means of a purge flow passing from the vapour collection device to the engine, the purge flow rate being varied by means of a flow control valve located between the vapour collection device and the engine, the engine control unit adapted to operate according to a method comprising the steps of determining a minimum valve signal value and a maximum valve signal value as a function of engine load and engine speed to thereby respectively define the minimum and maximum extent of valve signal values for controlling opening of the valve, said function being independent of exhaust-air/fuel ratio feedback control; and selecting either one of the minimum valve signal value, maximum valve signal value, and an interpolation between the maximum and minimum valve signal values in which said selecting is performed in dependence on engine operating conditions so as to optimise an amount of fuel purged from the vapour collection device, wherein the amount of interpolation between the respective minimum and maximum valve signal values is provided by an adaption value for obtaining an intermediate valve signal value between said minimum and maximum valve signal values the method further including determining the adaption value as a function of a coolant temperature of the engine, including determining an initial adaption value upon first starting up the engine, such that the initial adaption value is relatively low if the engine coolant temperature is relatively high to thereby restrict a purge air flow to the engine and such that the initial adaption value is relatively high if the engine coolant temperature is relatively low to thereby provide for a greater purge air flow to the engine.

12. The engine control unit according to claim 11 further including periodically varying the adaption value with changing operating conditions of the engine.

13. The engine control unit according to claim 11 wherein the engine is operated under closed loop speed control at idle operation of the engine and is operated under open loop control under other engine operating conditions.

14. The engine control unit according to claim 13 when the engine is at idle, further including varying the adaption value by comparing an idle fueling level to the engine to a specified target fueling level, incrementing the adaption value by a specified amount if the idle fueling level is above the target fueling level, and decrementing the adaption value by a specified amount if the idle fueling level is below the target fueling level.

15. The engine control unit according to claim 11 further including adding a specified air flow offset en the adaption value is decremented and removing a specified air flow offset when the adaption value is incremented.

16. The engine control unit according to claim 14 further including comparing the idle fueling level to a specified limit value if the idle fueling level is less than the specified target fueling level, and setting the adaption value to zero if the idle fueling level is less than the limit value.

17. The engine control unit according to claim 16 further including adding a specified air flow offset if said adaption value is set to zero.

18. The engine control unit according to claim 14 further including varying the adaption value following a specified period after a last variation of the adaption value or since the entry of the engine into idle operation.

19. The engine control unit according to claim 13 when the engine is operating under open loop control, further including periodically decrementing the adaption value by a preset amount.

20. The engine control unit according to claim 11 wherein the fuel is purged into the intake manifold of the engine.

21. An internal combustion engine comprising at least one combustion chamber and adapted to, in use, deliver fuel from a vapour collection device to said at least one combustion chamber to thereby purge fuel that has accumulated in the vapour collection device by means of a purge flow passing from the vapour collection device to the engine, the purge flow rate being varied by means of a flow control valve located between the vapour collection device and the engine, the engine adapted to operate according to a method comprising the steps of determining a minimum valve signal value and a maximum valve signal value as a function of engine load and engine speed to thereby respectively define the minimum and maximum extent of valve signal values for controlling opening of the valve, said function being independent of exhaust-air/fuel ratio feedback control; and selecting either one of the minimum valve signal valve, maximum valve signal value, and an interpolation between the maximum and minimum valve signal values in which said selecting is performed in dependence on engine operating conditions so as to optimise an amount of fuel purged from the vapour collection device, wherein the amount of interpolation between the respective minimum and maximum valve signal values is provided by an adaption value for obtaining an intermediate valve signal value between said minimum and maximum valve signal values, the method further including determining the adaption value as a function of a coolant temperature of the engine, wherein the engine is operated under closed loop speed control at idle operation of the engine and is operated under open loop control under other engine operating conditions.

22. The engine according to claim 21 further including periodically varying the adaption value with changing operating conditions of the engine.

23. The engine according to claim 21 including determining an initial adaption value upon first starting up the engine, such that the initial adaption value is relatively low if the engine coolant temperature is relatively high to thereby restrict a purge air flow to the engine and such that the initial adaption value is relatively high if the engine coolant temperature is relatively low to thereby provide for a greater purge air flow to the engine.

24. The engine according to claim 21 when the engine is at idle, further including varying the adaption value by comparing an idle fueling level to the engine to a specified target fueling level, incrementing the adaption value by a specified amount if the idle fueling level is above the target fueling level, and decrementing the adaption value by a specified amount if the idle fueling level is below the target fueling level.

25. The engine according to claim 21 further including adding a specified air flow offset when the adaption value is decremented and removing a specified air flow offset when the adaption value is incremented.

26. The engine according to claim 24 further including comparing the idle fueling level to a specified limit value if the idle fueling level is less than the specified target fueling level, and setting the adaption value to zero if the idle fueling level is less than the limit value.

27. The engine according to claim 26 further including adding a specified air flow offset if said adaption value is set to zero.

28. The engine according to claim 21 further including varying the adaption value following a specified period after a last variation of the adaption value or since the entry of the engine into idle operation.

29. The engine according to claim 21 when the engine is operating under open loop control, further including periodically decrementing the adaption value by a preset amount.

30. The engine according to claim 21 wherein the fuel is purged into the intake manifold of the engine.

* * * * *

UNITED STATES PATENT AND TRADEMARK OFFICE

CERTIFICATE OF CORRECTION

PATENT NO. : 6,305,360 B1
DATED : October 23, 2001
INVENTOR(S) : Richard W. Hurley It is certified that error appears in the above-identified patent and that said Letters Patent is hereby corrected as shown below:

Title page,
Item [75], Inventor, address should read as -- Glen Waverley --
Item [73], Assignee, name should read as -- Orbital Engine Company (Australia) Pty Limited --

Signed and Sealed this

Seventh Day of May, 2002

*Attest:*

*Attesting Officer*

JAMES E. ROGAN
*Director of the United States Patent and Trademark Office*